US010276980B2

(12) United States Patent
Benichou et al.

(10) Patent No.: US 10,276,980 B2
(45) Date of Patent: Apr. 30, 2019

(54) CONNECTOR WITH A CPA RECEIVING SPACE AND CONNECTOR ASSEMBLY COMPRISING SUCH A CONNECTOR

(71) Applicant: TE Connectivity Germany GmbH, Bensheim (DE)

(72) Inventors: Jonathan Benichou, Mannheim (DE); Christian Boemmel, Langen (DE); Rolf Jetter, Darmstadt (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 15/653,999

(22) Filed: Jul. 19, 2017

(65) Prior Publication Data

US 2017/0317448 A1 Nov. 2, 2017

Related U.S. Application Data

(63) Continuation of application No. PCT/EP2016/051325, filed on Jan. 22, 2016.

(30) Foreign Application Priority Data

Jan. 22, 2015 (DE) ..... 10 2015 201 089

(51) Int. Cl.
*H01R 13/641* (2006.01)
*H01R 13/627* (2006.01)
(Continued)

(52) U.S. Cl.
CPC ..... *H01R 13/641* (2013.01); *H01R 13/245* (2013.01); *H01R 13/50* (2013.01); *H01R 13/6272* (2013.01)

(58) Field of Classification Search
CPC ..... H01R 13/639; H01R 2103/00; H01R 2201/26; H01R 13/641; H01R 25/162;
(Continued)

(56) References Cited

U.S. PATENT DOCUMENTS 5,803,651 A 9/1998 Saito
6,045,388 A 4/2000 Higgins et al.
(Continued)

FOREIGN PATENT DOCUMENTS

CN 101548440 A 9/2009
CN 101563817 A 10/2009
JP H09219255 A 8/1997

OTHER PUBLICATIONS

PCT International Preliminary Report on Patentability, Application No. PCT/EP2016/051325, dated Jul. 25, 2017, 8 pages.
(Continued)

*Primary Examiner* — Truc T Nguyen
(74) *Attorney, Agent, or Firm* — Barley Snyder

(57) ABSTRACT

A connector comprises a connector face, a latch, and a CPA receiving space. A plurality of contact receiving spaces of the connector are open to the connector face. The latch engages a mating connector when the connector is inserted into the mating connector along an insertion direction. The CPA receiving space is disposed adjacent an inner side of the latch and receives a position securing member. At least one contact receiving space is disposed between the connector face and the CPA receiving space.

23 Claims, 6 Drawing Sheets

(51) Int. Cl.
*H01R 13/24* (2006.01)
*H01R 13/50* (2006.01)

(58) Field of Classification Search
CPC ..... H01R 13/6273; H01R 13/516; H01R 13/6272; H01R 13/4223; H01R 13/6275; H01R 13/652; H01R 24/78; H01R 25/006; H01R 31/06
See application file for complete search history.

(56) References Cited

U.S. PATENT DOCUMENTS 7,326,074 B1 2/2008 Lim et al.
2002/0045380 A1 4/2002 Endo et al.
2008/0139035 A1 6/2008 Kim et al.
2009/0023325 A1 1/2009 Chen et al.
2012/0282791 A1* 11/2012 Brown ..... H01R 13/639 439/157
2014/0004732 A1* 1/2014 Heil ..... H01R 13/6275 439/352
2014/0335720 A1* 11/2014 Like ..... H01R 13/645 439/374
2015/0111405 A1 4/2015 Boemmel et al.
2015/0147901 A1* 5/2015 Wu ..... H01R 13/639 439/357
2015/0295354 A1* 10/2015 Morello ..... H01R 13/639 439/352
2016/0079703 A1* 3/2016 Nakashima ..... H01R 13/641 439/352

OTHER PUBLICATIONS

Chinese First Office Action, English translation, dated Aug. 1, 2018, 8 pages.
Japanese Notice of Reasons for Refusal, English translation, dated Jul. 24, 2018, 3 pages.

* cited by examiner

88

CONNECTOR WITH A CPA RECEIVING SPACE AND CONNECTOR ASSEMBLY COMPRISING SUCH A CONNECTOR

CROSS-REFERENCE TO RELATED APPLICATIONS

This application is a continuation of PCT International Application No. PCT/EP2016/051325, filed on Jan. 22, 2016, which claims priority under 35 U.S.C. § 119 to German Patent Application No. 102015201089.9, filed on Jan. 22, 2015.

FIELD OF THE INVENTION

The present invention relates to a connector which can be inserted into a mating connector and, more particularly, to a connector having a latch and a CPA receiving space.

BACKGROUND

As is known in the art, in order to secure a connector in a mating connector, many connectors have a latch arm or other engaging means engaging with the mating connector. In order to prevent inadvertent release of the latch arm and a loss of the engagement between the connectors, a Connector Position Assurance ("CPA") receiving space adjoins the latch arm at an inner side of the connector. A position securing member can be inserted in the CPA receiving space in order to prevent movement of the latch arm. Generally, the position securing member is inserted completely into the CPA receiving space only when the connector is completely inserted into the mating connector. Position securing members further prevent insertion into the CPA receiving space if the connector is not yet completely inserted in the mating connector.

Connectors with CPA receiving spaces improve the reliability of connection with a mating connector. However, it is disadvantageous that the connectors, the mating connectors, and the position securing members are each constructed for a specific application and generally allow little compatibility between different constructions, leading to development and production costs.

SUMMARY

A connector according to the invention comprises a connector face, a latch, and a CPA receiving space. A plurality of contact receiving spaces of the connector are open to the connector face. The latch engages a mating connector when the connector is inserted into the mating connector along an insertion direction. The CPA receiving space is disposed adjacent an inner side of the latch and receives a position securing member. At least one contact receiving space is disposed between the connector face and the CPA receiving space.

BRIEF DESCRIPTION OF THE DRAWINGS

The invention will now be described by way of example with reference to the accompanying figures, of which.

DETAILED DESCRIPTION OF THE EMBODIMENT(S)

Figure 1:
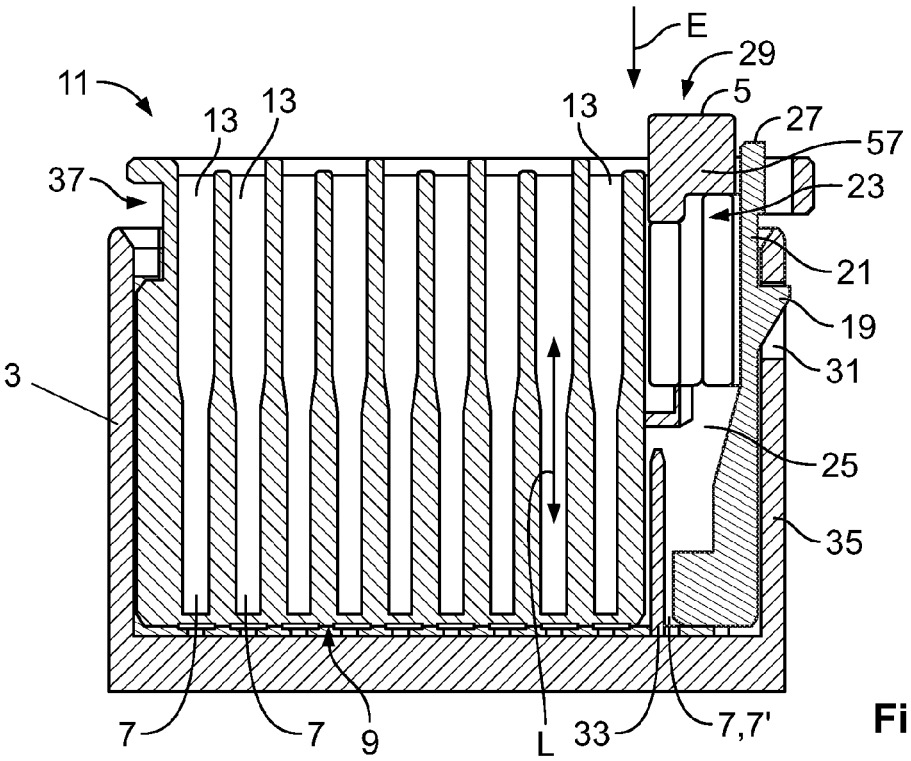
FIG. 1 is a sectional view of a connector according to the invention in a mating connector and having a position securing member inserted into the connector.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein; rather, these embodiments are provided so that the present disclosure will be thorough and complete, and will fully convey the concept of the disclosure to those skilled in the art.

Figure 2:
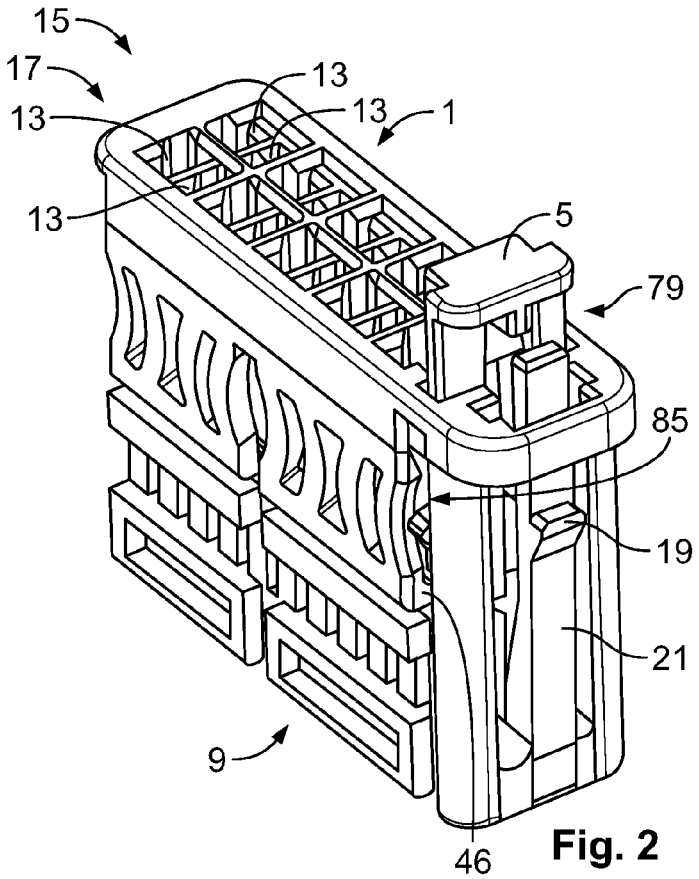
FIG. 2 is a perspective view of the connector with the position securing member in a preliminary engagement position.

A connector 1 according to the invention is shown in FIGS. 1 and 2. The connector 1, as shown in FIG. 1, has a position securing member 5 and is capable of being inserted into a mating connector 3.

The connector 1, as shown in FIGS. 1 and 2, has a plurality of contact receiving spaces 7 which open in the direction towards a connector face 9. At a rear end 11 opposite the connector face 9, the connector 1 has a plurality of passageways 13. Each passageway 13 extends continuously and substantially rectilinearly to the connector face 9 as far as a contact receiving space 7. The passageways 13 receive electrical contacts, such as contact pins or sockets (not shown) in the connector 1. In the shown embodiment, the passageways 13 and the contact receiving spaces 7 which are formed continuously with passageways 13 are arranged in two rows 15 and 17 which extend parallel with each other.

The connector 1, as shown in FIGS. 1 and 2, has a latch 19 disposed on an outer side of the connector 1. The latch 19 extends away from the rest of the connector 1 and is spaced apart from the rear end 11 of the connector 1. The latch 19 is disposed on a resiliently deflectable insertion arm 21. The latch 19 can be formed monolithically with the insertion arm 21.

A CPA receiving space 23 for the position securing member 5 adjoins an inner side of the latch 19, as shown in FIGS. 1 and 2. The CPA receiving space 23 is capable of receiving the position securing member 5 in a positive-locking manner, as described in greater detail below. In the shown embodiment, at least one contact receiving space 7' is located between the connector face 9 and the CPA receiving space 23. The CPA receiving space 23 opens in the direction towards the rear end 11 of the connector 1 facing away from the connector face 9. The position securing member 5 is thereby inserted into the CPA receiving space 23 from the rear end 11 along an insertion direction E extending parallel with a longitudinal direction L of the contact receiving spaces 7. The passageways 13 also extend parallel with the longitudinal direction L. The CPA receiving space 23 forms a common chamber 25 with the contact receiving space 7', which is disposed between the common chamber 25 and the connector face 9.

The insertion arm 21 in an undeflected state shown in FIG. 1 extends substantially parallel with the insertion direction E to the rear end 11 of the connector 1. A free end 27 of the insertion arm 21 extends as far as the rear end 11 or beyond it; in the embodiment shown, the free end 27 extends beyond the rear end 11 of the connector 1. Operation of the latch 19 is thereby made easier. The insertion arm 21 and the latch 19 are formed monolithically with the rest of the connector 1 and merge into the rest of the connector 1 in a region of the connector face 9. The latch 19 is disposed at the height of the CPA receiving space 23 in the longitudinal direction L or insertion direction E.

The mating connector 3 and an insertion of the connector 1 into the mating connector 3 are described below with reference to FIGS. 1 and 3.

Figure 3:
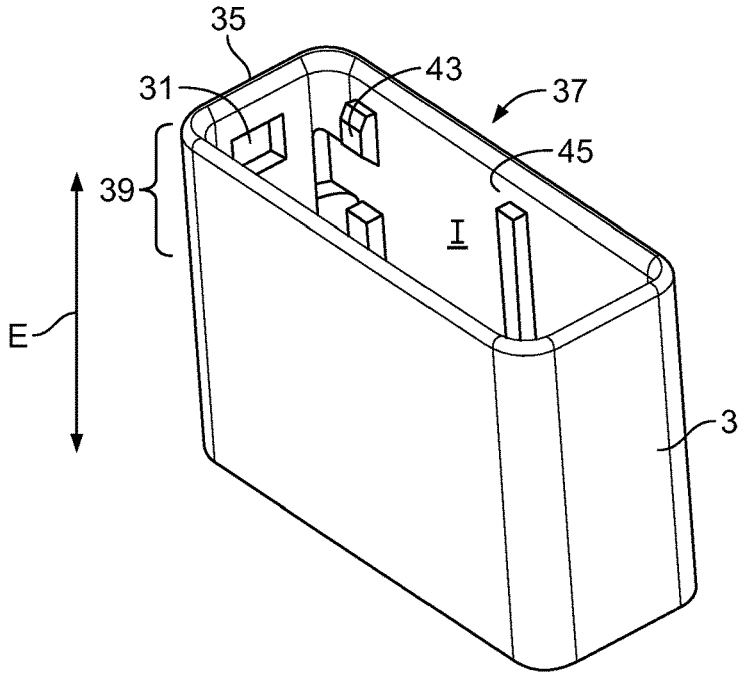
FIG. 3 is a perspective view of the mating connector.

The mating connector 3, as shown in FIG. 3, has an input opening 37. The connector 1 is inserted into the input opening 37 parallel with the insertion direction E. When the connector 1 is completely inserted, the latch 19 secures the connector 1 in the mating connector 3. The mating connector 3 has an engaging opening 31 at a short side 35 into which the latch 19 penetrates. Deflection of the latch 19 towards the rest of the connector 1 can result in disengagement of the connector 1 in the mating connector 3.

The engaging opening 31, as shown in FIG. 3, is disposed in an upper third 39 of the mating connector 3 in the insertion direction E, the upper third 39 located at a side of the mating connector 3 with the input opening 37. The mating connector 3 has an activating element 43 at a long side 41. The activating element 43 projects from an inner wall 45 of the long side 41 into the inner side I of the mating connector 3 and is disposed in the upper third 39 of the mating connector 3. The activating element 43 is located substantially at the height of the engaging opening 31. So that the insertion of a connector 1 into the mating connector 3 is not impeded by the activating element 43, the connector 1 has an outer guiding channel 46 shown in FIG. 2 which extends parallel with the insertion direction E and opens in the direction towards the connector face 9. The activating element 43 moves through the outer guiding channel 46 during insertion. In the region of the guiding channel 46, the connector 1 has a slot 85 which opens the CPA receiving space 23 into the guiding channel 46.

The mating connector 3 has a plurality of contacts 33 which may be pin or socket contacts; only one contact 33 is shown in FIG. 1, additional contacts 33 were omitted from FIG. 1 for the sake of clarity. The contacts 33 extend in an elongated manner into an inner space I of the mating connector 3. The contacts 33 form an electrically conductive connection with electrical contact elements (not shown) disposed in the passageways 13 and/or in the contact receiving spaces 7, 7' of the connector 1. If the connector 1 is completely inserted in the mating connector 3, as shown in FIG. 1, the contacts 33 extend into the contact receiving spaces 7, 7' of the connector 1, forming the conductive connection. The connector 1 allows at least one contact 33 of the mating connector 3 to be received in the contact receiving space 7' without a function of the position securing member 5 being inhibited.

The at least one contact 33 which projects into the contact receiving space 7 does not necessarily have to make electrical contact, the at least one contact 33 received in the contact receiving space 7' as shown in FIG. 1 may be aligned with the CPA receiving space 23. Due to the two rows 15, 17, in an inserted state, two contacts 33 of the mating connector 3 may be located between the CPA receiving space 23 and the connector face 9. The connector 1 may have either two individual contact receiving spaces 7' in order to receive a contact 33, or one common contact receiving space 7' which extends continuously and transversely relative to the two rows 15 and 17 and which receives two contacts 33.

Figure 4:
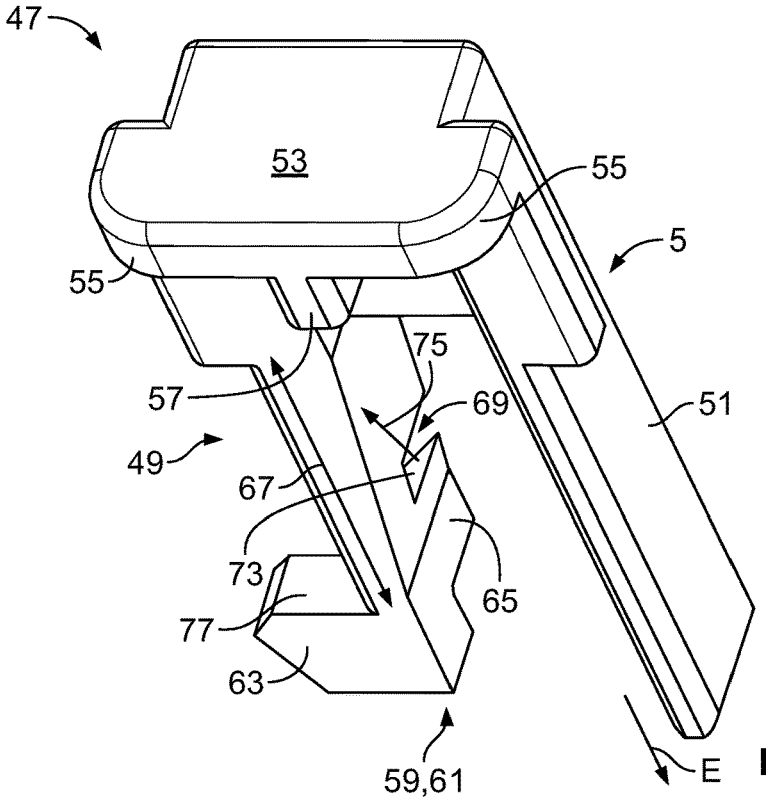
FIG. 4 is a perspective view of the position securing member.
Figure 5:
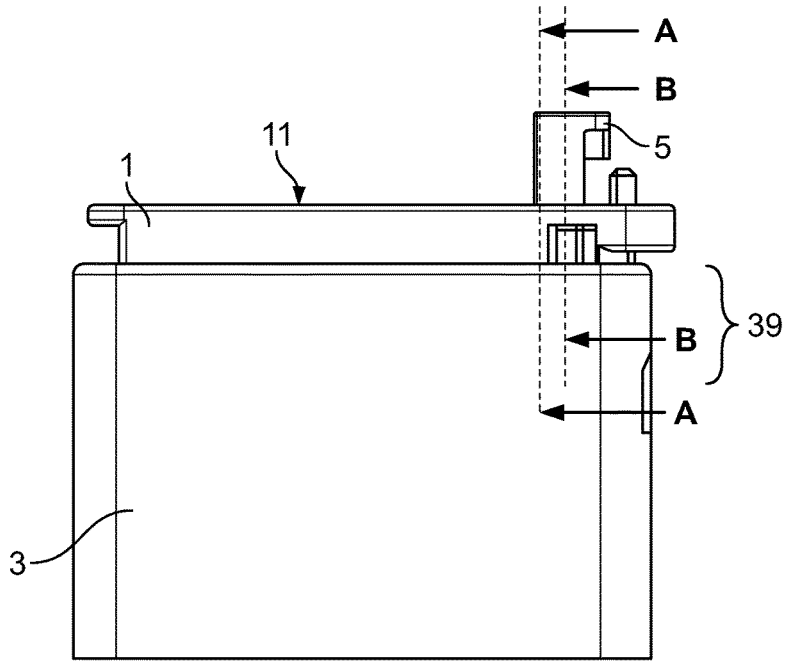
FIG. 5 is a front view of the connector in the mating connector with the position securing member inserted.

The position securing member 5 is shown in FIG. 4. The position securing member 5 has a handling end 47 and a securing arm 49 and a guiding arm 51 extending from the handling end 47. The securing arm 49 and the guiding arm 51 extend parallel with each other along the insertion direction E. The securing arm 49 and the guiding arm 51 are spaced apart from each other. The guiding arm 51 is substantially of the same length as the securing arm 49.

The handling end 47 has a planar pressing face 53. By pressing on the pressing face 53 manually or by a machine, the position securing member 5 is moved in the insertion direction E into the CPA receiving space 23 of the connector 1 as shown in FIG. 1. At the handling end 47, gripping projections 55 extend perpendicularly to the guiding arm 51. The gripping projections 55 enable withdrawal of the position securing member 5 from the connector 1 counter to the insertion direction E. In another embodiment, only a single gripping projection 55 may be provided.

A positive-locking projection 57 is disposed on the handling end 47 of the position securing member 5, as shown in FIG. 4. The positive-locking projection 57 protrudes in the insertion direction E and perpendicularly thereto. The positive-locking projection 57 projects from the gripping projections 55 in the insertion direction E and is disposed centrally between the two gripping projections 55.

The securing arm 49, as shown in FIG. 4, has a securing head 61 at an end 59 thereof opposite the handling end 47. An activating projection 63 and an engaging projection 65 extend from the securing head 61 in two different directions. The activating projection 63 and the engaging projection 65 extend perpendicularly to each other and substantially perpendicularly away from a longitudinal direction 67 of the securing arm 49. The longitudinal direction 67 is parallel with the insertion direction E. In the shown embodiment, the guiding arm 51 has a planar cross-section. In other embodiments, the guiding arm 51 can have a round cross-section, a square cross-section or any other suitable cross-section. The guiding arm 51 does not have any elements projecting therefrom. The activating projection 63 and the engaging projection 65 are disposed at least partially at the same height in the longitudinal direction 67 of the securing arm 49.

The securing arm 49 has, between the engaging projection 65 and the handling end 47, a recess 69 shown in FIG. 4 for receiving a securing counter-element 71 of the connector 1; the recess 69 has an engaging face 73 which forms a positive-locking connection with the securing counter-element 71 of the connector 1. A surface normal 75 of the engaging face 73 is directed substantially in the direction towards the handling end 47. The surface normal 75 is directed in a direction towards the handling end 47 and in the direction of the activating projection 63. The engaging face 73 is thereby chamfered. In the longitudinal direction 67, the recess 69 is at least partially at the height of the activating projection 63. Therefore, the recess 69 and at least one upper side 77 of the activating projection 63 can overlap each other transversely relative to the longitudinal direction 67. As a result of the arrangement described for the activating projection 63, engaging projection 65 and recess 69, the position securing member 5 is compact; the functions of engagement and activation are arranged beside each other substantially transversely relative to the longitudinal direction 67, so the securing arm 49 can have a short structural form.

The function of the position securing member 5 according to the invention for securing the connector 1 in the mating connector 3 is described below with reference to FIGS. 5-12.

Figure 6:
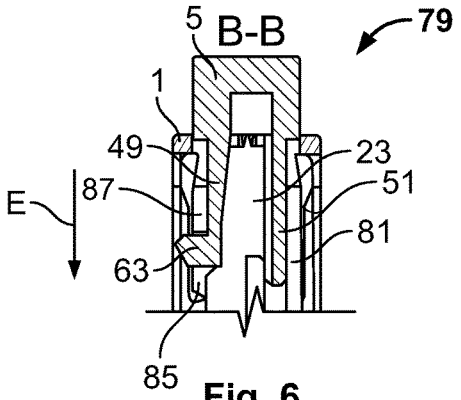
FIG. 6 is a sectional view of the position securing member in the connector in the preliminary engagement position, taken along line B-B of FIG. 5.
Figure 7:
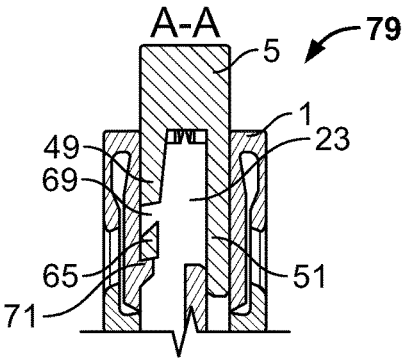
FIG. 7 is a sectional view of the position securing member in the connector in the preliminary engagement position, taken along line A-A of FIG. 5.
Figure 8:
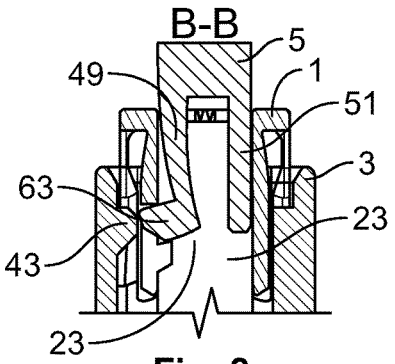
FIG. 8 is a sectional view of the connector in the mating connector with the position securing member in the preliminary engagement position, taken along line B-B of FIG. 5.
Figure 9:
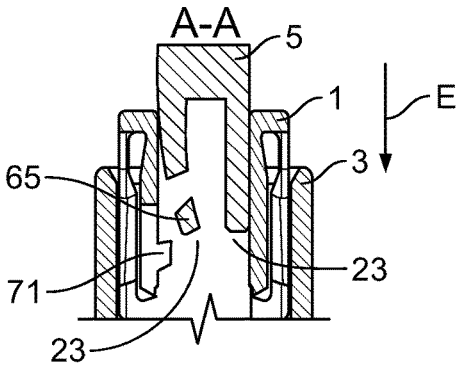
FIG. 9 is a sectional view of the connector in the mating connector with the position securing member in the preliminary engagement position, taken along line A-A of FIG. 5.
Figure 10:
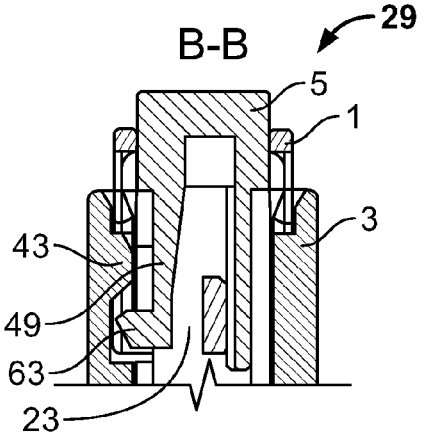
FIG. 10 is a sectional view of the connector in the mating connector with the position securing member in the final engagement position, taken along line B-B of FIG. 5.
Figure 11:
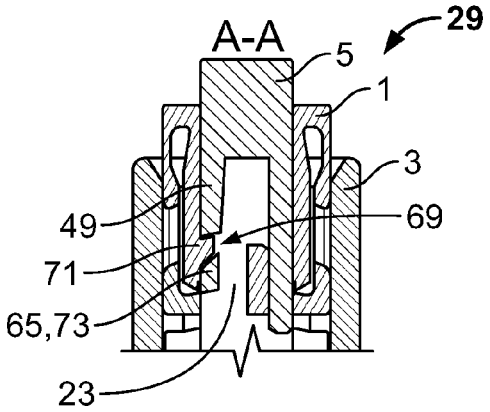
FIG. 11 is a sectional view of the connector in the mating connector with the position securing member in the final engagement position, taken along line A-A of FIG. 5.

FIGS. 6 and 7 show a preliminary engagement position 79 of the position securing member 5 in the connector 1 without the mating connector 3, FIGS. 8 and 9 show the connector 1 which is inserted into the mating connector 3, and FIGS. 10 and 11 show the position securing member 5 in a final engagement position 29.

In the preliminary engagement position 79, shown in FIGS. 2, 6, and 7, the position securing member 5 is partially inserted into the CPA receiving space 23. The guiding arm 51 is guided along an inner wall 81 of the CPA receiving space 23 and between the inner wall 81 and a guiding element 83. The guiding element 83 extends in the insertion direction E. In the preliminary engagement position 79, the activating projection 63 is received in the slot 85 of the connector 1 so that the securing arm 49 is not deflected. The slot 85 extends parallel with the insertion direction E. The securing counter-element 71 of the connector 1 in the CPA receiving space 23 prevents, as a result of a positive-locking connection with the securing head 61 or with the securing projection 65, further insertion of the position securing member 5 in the insertion direction E as shown in FIG. 7. It can thereby be ensured that the position securing member 5 cannot be completely inserted into the CPA receiving space 23 while the connector 1 is not completely inserted into the mating connector 3. As a result of an additional positive-locking connection between the activating projection 63 and an inner wall 87 of the connector 1 delimiting the slot 85 counter to the insertion direction E, the position securing member 5 is secured to prevent falling out of or release from the connector 1.

The connector 1 is then completely inserted into the mating connector 3 as shown in FIGS. 8 and 9. In this completely inserted state, the activating element 43 of the mating connector 3 projects so far into the slot 85 that the activating projection 63 is moved away from the activating element 43. The securing arm 49 is thereby deflected in the direction towards the guiding arm 51. Deflection of the securing arm 49 brings about a movement of the securing head 61 away from the securing counter-element 71. The positive-locking connection is thereby removed, and the position securing member 5 is no longer blocked in the insertion direction E.

The position securing member 5 is then inserted into the CPA receiving space 23 to the final engagement position 29, shown in FIGS. 1, 10, and 11. In the final engagement position 29, the activating projection 63 has passed the activating element 43, and the securing arm 49 is no longer deflected. In the no longer deflected state, the securing counter-element 71 projects into the recess 69 of the securing arm 49. The engaging projection 65 abuts against the securing counter-element 71 with the engaging face 73 thereof in a positive-locking manner.

As shown in FIG. 1, in the final engagement position 29, the position securing member 5 blocks deflection of the latch 19 at the rear end 11 by a positive-locking connection with the insertion arm 21. The positive-locking projection 57 forms the positive-locking connection with the latch 19. The handling end 47 is directed towards the rear end 11 or projects therefrom out of the connector 1, counter to the insertion direction E.

Figure 12:
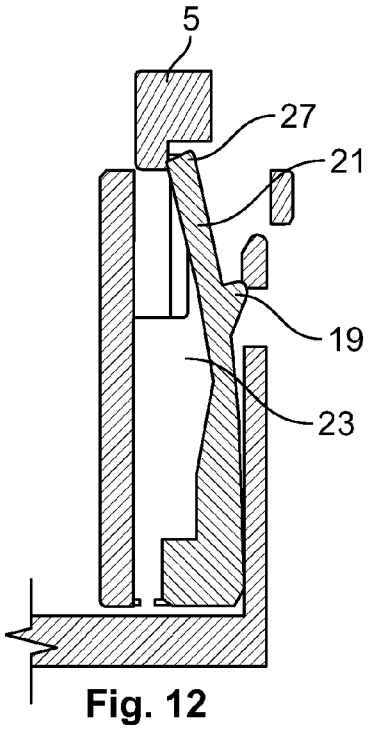
FIG. 12 is a sectional view of the connector in the mating connector without the position securing member.

As shown in FIG. 12, if no position securing member 5 is disposed in the CPA receiving space 23, the insertion arm 21 extends into the CPA receiving space 23. When the insertion arm 21 extends into the CPA receiving space 23, the insertion arm 21 prevents the insertion of the position securing member 5 into the CPA receiving space 23.

Figure 13:
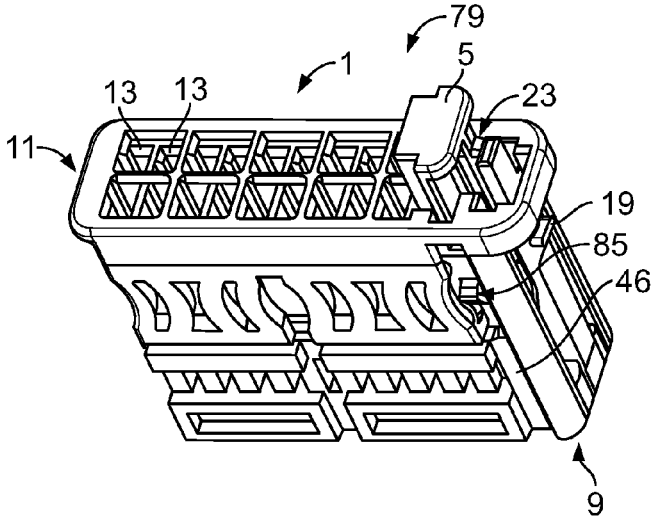
FIG. 13 is a perspective view of the connector.
Figure 14:
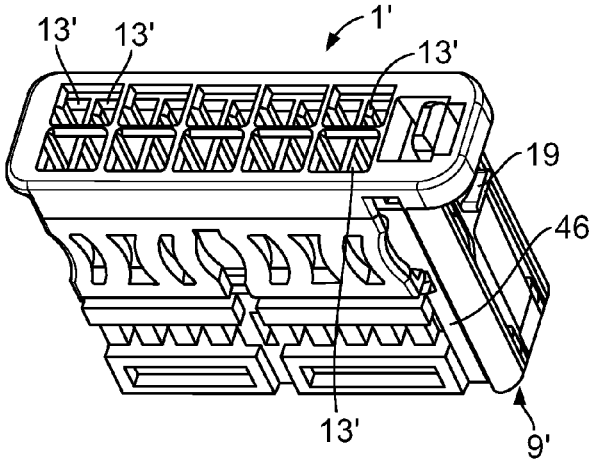
FIG. 14 is a perspective view of a connector according to another embodiment of the invention.
Figure 15:
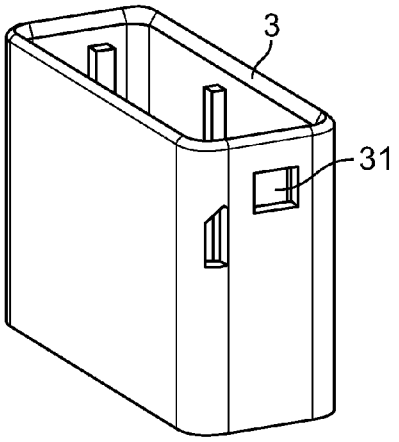
FIG. 15 is a perspective view of the mating connector.

A connector assembly 88 including the mating connector 3 and the connector 1 described with reference to FIGS. 1-12 and a connector 1' according to another embodiment of the invention is shown in FIGS. 13-15.

The connector 1', as shown in FIG. 14, does not have a CPA receiving space. Both the connector 1 shown in FIG. 13 and the connector 1' shown in FIG. 14 can be inserted into the mating connector 3 shown in FIG. 15. The connectors 1 and 1' have an identical outer contour at least in the region of the connector faces 9, 9'. Both connectors 1 and 1' have a guiding channel 46 by which the activating element 43 can be guided. However, only the connector 1 has a slot 85 which opens the guiding channel 46 with respect to the CPA receiving space 23. The connectors 1 and 1', as shown in FIGS. 13 and 14, each have the latch 19 engaging with the engaging opening 31 of the mating connector 3. Thus, both connectors 1 and 1' can be used together with the mating connector 3 according to the invention, and a reconfiguration of the mating connector 3 is not necessary depending on whether a connector 1, 1' does or does not have a CPA receiving space 23.

The connector 1 has a plurality of passageways 13 at the rear end 11 thereof, and the connector 1' has corresponding passageways 13'. The connector 1' without a CPA receiving space has at least one passageway 13' more than the connector 1; in the shown embodiment, two more passageways 13' are present than in the connector 1. The CPA receiving space 23 is formed in the connector 1 at the expense of passageways 13. The structural space of the connector 1 may thereby be substantially identical to the structural space of the connector 1'. The mating connector 3 can always be the same shape, irrespective of whether the connector 1 with the CPA receiving space 23 or the connector 1' without a CPA receiving space is intended to be used.

The mating connector 3 has the same number of contacts 33 irrespective of the connector 1, 1' used. Similarly, both connectors 1 and 1' can have an identical number of contact receiving spaces 7. If, for example, a number of contacts 33 which corresponds to the number of passageways 13' in the connector 1' is used in the mating connector 3, each of the contacts 33 can be electrically connected via a passageway 13' in the connector 1'. If, however, the connector 1 according to the invention with the CPA receiving space 23 is inserted into the mating connector 3, no contact is made with at least the contacts 33 which project into the at least one contact receiving space 7', because the at least one contact receiving space 7' is not connected to a passageway 13, but is instead arranged between the CPA receiving space 23 and the connector face 9. The function of the position securing member 5 is not disrupted by receiving at least one contact 33 in the contact receiving space 7'.

Figure 16:
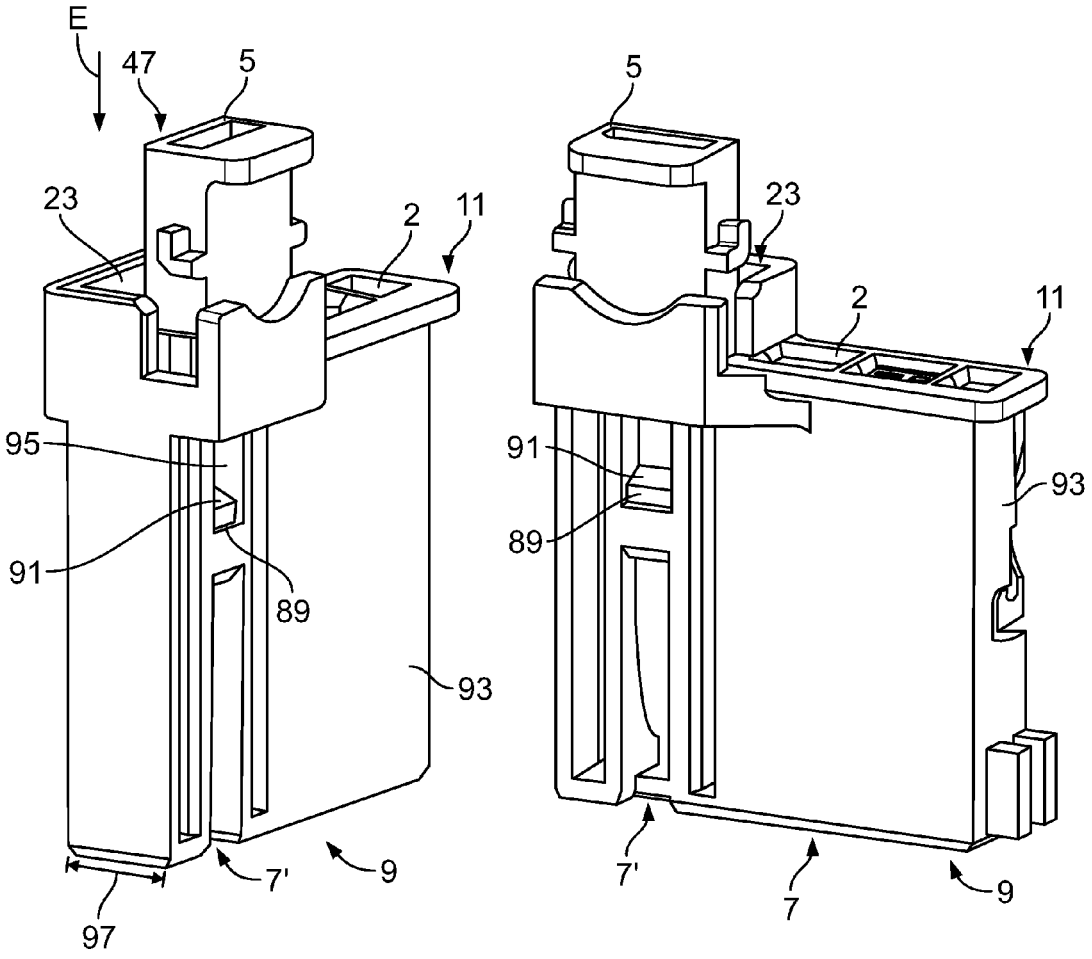
FIG. 16 is a perspective view of a connector according to another embodiment of the invention.

A connector 2 according to another embodiment of the invention is shown in FIG. 16. The connector 2 has a plurality of contact receiving spaces 7. The contact receiving spaces 7 open with respect to the connector face 9. The connector 2 has a CPA receiving space 23 which is open towards the rear end 11 of the connector 2. For the connector 2, there is provided a position securing member 5 which has an engaging arm 89 from which a latch 91 projects transversely relative to the insertion direction E. The engaging arm 89 can be deflected perpendicularly relative to a long side 93 of the connector 2. A contact receiving space 7' is arranged between a receiving member 95 for the engaging arm 89 and the connector face 9. In order to keep the structural form of the connector 2 small, and in order to allow the connector 2 to have the same dimensions both with a CPA receiving space 23 and without a CPA receiving space 23, the connector 2 has a constant width 97 parallel with the long side 93 and perpendicularly to the insertion direction E. The connector 2 is widened only at the rear end 11 in order to receive a handling end 47 of the position securing member 5.

What is claimed is:

1. A connector, comprising:

a connector face to which a plurality of contact receiving spaces are open;

a latch disposed on a resilient insertion arm and engaging a mating connector when the connector is inserted into the mating connector along an insertion direction; and a CPA receiving space disposed adjacent an inner side of the latch and receiving a position securing member, at least one contact receiving space disposed between the connector face and the CPA receiving space and aligned with the CPA receiving space along the insertion direction.

2. The connector of claim 1, wherein the CPA receiving space is open in a direction toward a rear end of the connector opposite the connector face.

3. The connector of claim 2, wherein the insertion arm extends in an undeflected state substantially parallel with the insertion direction to the rear end.

4. The connector of claim 3, wherein, in a deflected state, the insertion arm extends into the CPA receiving space.

5. The connector of claim 2, wherein the position securing member blocks deflection of the insertion arm when the position securing member is fully inserted to a final engagement position in the CPA receiving space.

6. A connector assembly, comprising:

a first connector with a CPA receiving space;

a second connector without a CPA receiving space; and a mating connector mating with one of the first connector and the second connector at a time and capable of receiving each of the first connector and the second connector.

7. The connector assembly of claim 6, wherein the first connector and the second connector each have a plurality of passageways disposed at a rear end and extending to a connector face opposite the rear end.

8. The connector assembly of claim 7, wherein the second connector has at least one passageway more than the first connector.

9. The connector assembly of claim 8, wherein the first connector and the second connector each have a plurality of contact receiving spaces at the connector face communicating with the passageways, the first connector and the second connector having a same number of contact receiving spaces.

10. A connector assembly, comprising:

a mating connector having a contact; and a connector insertable into the mating connector along an insertion direction, the connector having a connector face to which a plurality of contact receiving spaces are open, a latch disposed on a resilient insertion arm and engaging the mating connector when the connector is inserted into the mating connector, and a CPA receiving space disposed adjacent an inner side of the latch and receiving a position securing member, at least one contact receiving space disposed between the connector face and the CPA receiving space in the insertion direction, the contact of the mating connector extending into the at least one contact receiving space and aligned with the CPA receiving space in the insertion direction when the connector is fully inserted into the mating connector.

11. The connector assembly of claim 10, wherein the position securing member has a handling end, a guiding arm extending from the handling end, and a securing arm extending from the handling end parallel to the guiding arm.

12. The connector assembly of claim 11, wherein the guiding arm and the securing arm are each aligned with the contact or one contact receiving space.

13. The connector assembly of claim 11, wherein the securing arm has a securing head at an end opposite the handling end, an activating projection and an engaging projection extending from the securing head in different directions.

14. The connector assembly of claim 13, wherein the activating projection deflects the securing arm during insertion of the connector into the mating connector.

15. The connector assembly of claim 14, wherein the engaging projection engages the connector when the position securing member is fully inserted to a final engagement position in the CPA receiving space.

16. The connector assembly of claim 15, wherein the activating projection and the engaging projection are disposed at a same height in a longitudinal direction of the securing arm.

17. The connector assembly of claim 15, wherein the connector has a securing counter-element and the securing arm has a recess disposed between the engaging projection and the handling end, the recess receiving the securing counter-element.

18. The connector assembly of claim 17, wherein the engaging projection has an engaging face adjacent the recess, a surface normal to the engaging face extending substantially in a direction toward the handling end.

19. The connector assembly of claim 18, wherein the recess is disposed at least partially at a height of the activating projection in a longitudinal direction of the securing arm.

20. The connector of claim 1, wherein the at least one contact receiving space is open to the connector face along the insertion direction.

21. A connector assembly, comprising:

a mating connector having a contact;

a position securing member having a handling end, a guiding arm extending from the handling end, and a securing arm extending from the handling end parallel to the guiding arm, the securing arm having a securing head at an end opposite the handling end, an activating projection and an engaging projection extending from the securing head in different directions; and a connector insertable into the mating connector along an insertion direction, the connector having a connector face to which a plurality of contact receiving spaces are open, a latch engaging the mating connector when the connector is inserted into the mating connector, a CPA receiving space disposed adjacent an inner side of the latch and receiving the position securing member, at least one contact receiving space disposed between the connector face and the CPA receiving space, the contact of the mating connector extending into the at least one contact receiving space and aligned with the CPA receiving space when the connector is fully inserted into the mating connector, the activating projection deflects the securing arm during insertion of the connector into the mating connector and the engaging projection engages the connector when the position securing member is fully inserted to a final engagement position in the CPA receiving space, and a securing counter-element, the securing arm having a recess disposed between the engaging projection and the handling end, the recess receiving the securing counter-element.

22. The connector assembly of claim 21, wherein the engaging projection has an engaging face adjacent the recess, a surface normal to the engaging face extending substantially in a direction toward the handling end.

23. The connector assembly of claim 22, wherein the recess is disposed at least partially at a height of the activating projection in a longitudinal direction of the securing arm.

* * * * *